US010556449B2

(12) United States Patent
Nakai et al.

(10) Patent No.: US 10,556,449 B2
(45) Date of Patent: Feb. 11, 2020

(54) LIQUID DISCHARGE APPARATUS AND IMAGE FORMING METHOD

(71) Applicants: Junji Nakai, Kanagawa (JP); Masafumi Yamada, Kanagawa (JP)

(72) Inventors: Junji Nakai, Kanagawa (JP); Masafumi Yamada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/136,000

(22) Filed: Sep. 19, 2018

(65) Prior Publication Data

US 2019/0100032 A1 Apr. 4, 2019

(30) Foreign Application Priority Data

Sep. 29, 2017 (JP) ..... 2017-191846

(51) Int. Cl.
*B41J 11/00* (2006.01)
*B41J 2/15* (2006.01)
*B41J 2/21* (2006.01)

(52) U.S. Cl.
CPC ..... *B41J 11/002* (2013.01); *B41J 2/15* (2013.01); *B41J 2/21* (2013.01); *B41J 2/2114* (2013.01)

(58) Field of Classification Search
CPC ..... B41J 11/002; B41J 11/0045; B41J 2/15; B41J 2/21
USPC ..... 347/101, 102, 104
See application file for complete search history.

(56) References Cited

U.S. PATENT DOCUMENTS

| | | | | |
|---|---|---|---|---|
| 9,327,524 | B1 * | 5/2016 | Yamada | B41J 11/002 |
| 2017/0182799 | A1 | 6/2017 | Nakai et al. | |
| 2017/0266990 | A1 | 9/2017 | Yoshinuma et al. | |
| 2017/0266991 | A1 | 9/2017 | Onodera et al. | |
| 2017/0320349 | A1 | 11/2017 | Matsumoto et al. | |
| 2017/0334217 | A1 | 11/2017 | Yoshinuma et al. | |
| 2018/0126751 | A1 | 5/2018 | Nakai et al. | |

FOREIGN PATENT DOCUMENTS

| | | |
|---|---|---|
| JP | 2004-090303 | 3/2004 |
| JP | 2009-241309 | 10/2009 |
| JP | 2009-285902 | 12/2009 |
| JP | 2011-126250 | 6/2011 |
| JP | 2012-006340 | 1/2012 |
| JP | 2015-147418 | 8/2015 |
| JP | 2017-056070 | 3/2017 |
| JP | 2017-207250 | 11/2017 |

* cited by examiner

*Primary Examiner* — An H Do
(74) *Attorney, Agent, or Firm* — Duft & Bornsen, PC

(57) ABSTRACT

A liquid discharge apparatus includes a conveyor to repeat conveyance of a recording medium by a predetermined distance and stop of conveyance of the recording medium; a liquid discharge head to discharge a liquid onto the recording medium; an irradiation device disposed downstream from the liquid discharge head in a direction of conveyance of the recording medium, to irradiate, with an electromagnetic wave, the recording medium onto which the liquid has been discharged by the liquid discharge head; and circuitry configured to control the irradiation device to irradiate the recording medium. The circuitry is configured to set a first irradiation amount during the stop of conveyance to a larger value than a value of a second irradiation amount during the conveyance of the recording medium.

9 Claims, 11 Drawing Sheets

LIQUID DISCHARGE APPARATUS AND IMAGE FORMING METHOD

CROSS-REFERENCE TO RELATED APPLICATIONS

This patent application is based on and claims priority pursuant to 35 U.S.C. § 119(a) to Japanese Patent Application No. 2017-191846, filed on Sep. 29, 2017, in the Japan Patent Office, the entire disclosure of which is hereby incorporated by reference herein.

BACKGROUND

Technical Field

The present disclosure relates to a liquid discharge apparatus and an image forming method.

Description of the Related Art

There are inkjet recording methods that include drying an ink landed on a recording medium in a case where the recording medium is made of, for example, an impermeable material such as acrylic resin, polyester, or vinyl chloride, or the recording medium is a slowly permeable material such as coated paper. In a case of drying an ink with warm air, the recording medium is not heated above a temperature of the air to be blown. Therefore, controlling the temperature is easy, but the ink is dried from a surface by heat conduction. Therefore, a coating film is formed on the surface of the ink to decrease a drying speed. In hot air drying, air is used as a medium, and therefore foreign matters tend to adhere to the ink.

In the case where infrared (IR: Infrared) which is one type of electromagnetic wave is used for drying ink, infrared rays pass through the inside of the coating film even if a coating film is formed on the surface of the ink. The infrared ray which has permeated the inside of the coating film is resonantly absorbed by the ink, as electromagnetic wave energy, and vibrates a molecule or an atom in the ink to generate frictional heat. For this reason, infrared drying has a remarkably high drying rate. However, in infrared drying, control of recording medium temperature is difficult and allows the recording medium to expand by excessive heating. Then, waves called cockling is easily caused on the recording medium.

SUMMARY

A liquid discharge apparatus according to a first aspect of the present invention includes a conveyor, a liquid discharge head, an irradiation device, and a circuitry. The conveyor repeats conveyance of a recording medium by a predetermined distance and stop of conveyance of the recording medium. The liquid discharge head discharges a liquid onto the recording medium. The irradiation device is disposed downstream from the liquid discharge head in a direction of conveyance of the recording medium, and the irradiation device irradiates, with an electromagnetic wave, the recording medium onto which the liquid has been discharged by the liquid discharge head. The circuitry is configured to control the irradiation device to irradiate the recording medium. The circuitry is configured to set a first irradiation amount during the stop of conveyance to a larger value than a value of a second irradiation amount during the conveyance of the recording medium.

Another embodiment provides an image forming method. The method includes intermittently conveying a recording medium to repeat conveyance of the recording medium by a predetermined distance and stop of conveyance; discharging a liquid onto the recording medium; irradiating the recording medium onto which the liquid has been discharged in the discharging with an electromagnetic wave in a predetermined irradiation amount; and setting a first irradiation amount during the stop of conveyance to a larger value than a value of a second irradiation amount during the conveyance of the recording medium.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
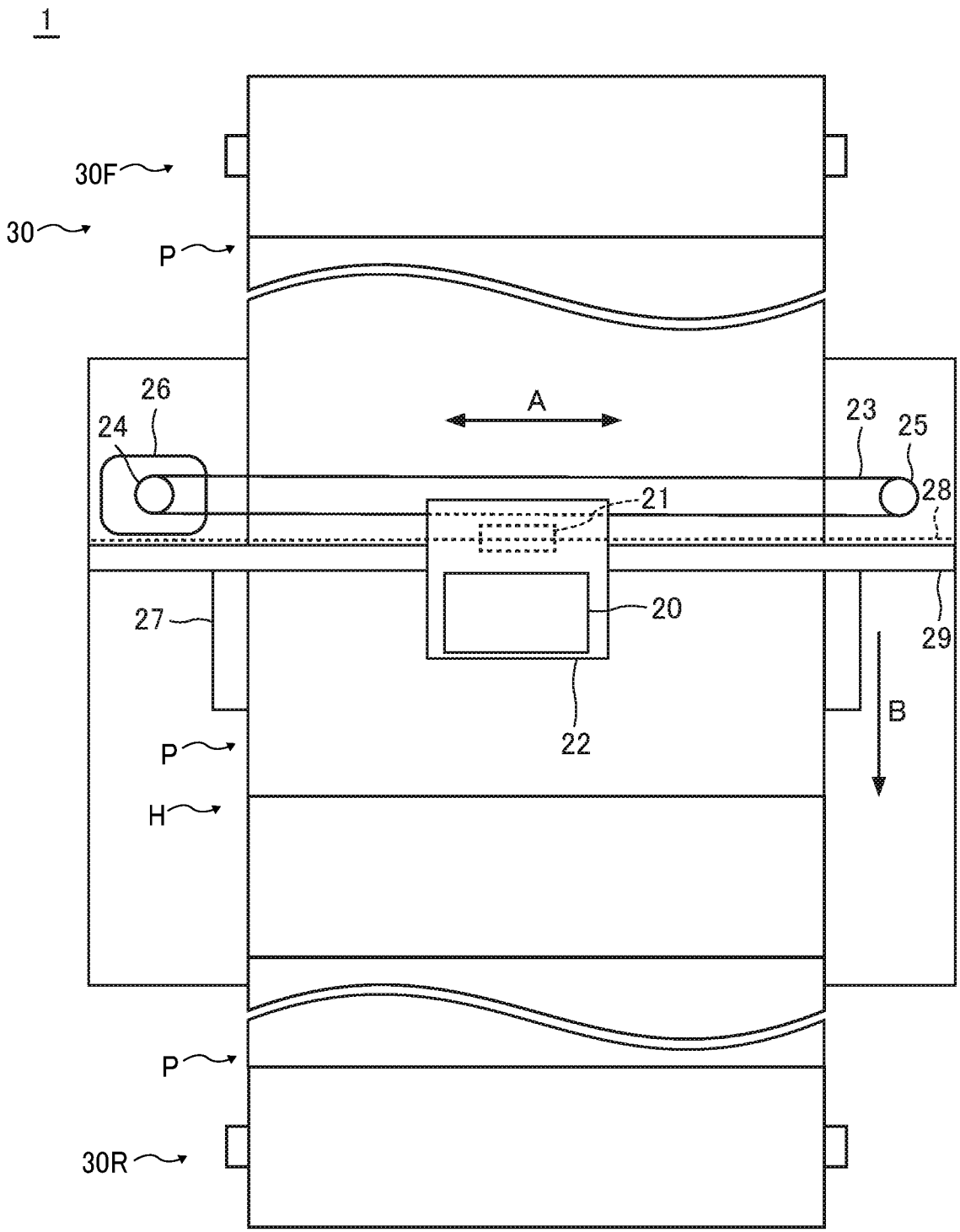
FIG. 1 is a schematic view illustrating a liquid discharge apparatus according to an embodiment of the present invention.

The accompanying drawings are intended to depict embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Liquid Discharge Apparatus

In the present disclosure, the term "liquid discharge apparatus" includes a liquid discharge head or a liquid discharge unit and drives the liquid discharge head to discharge liquid. The term "liquid discharge apparatus" used here includes, in addition to apparatuses to discharge liquid to materials to which the liquid can adhere, apparatuses to discharge the liquid into gas (air) or liquid. The liquid discharge apparatus can also include devices to feed, convey, and eject the material onto which liquid adheres. The liquid discharge apparatus can further include a pretreatment device to apply treatment liquid to the material before liquid is discharged onto the material and a post-treatment device to apply treatment liquid to the material after liquid is discharged onto the material.

The above-mentioned "material to which liquid adheres" may be any material as long as liquid can temporarily adhere such as paper, thread, fiber, cloth, leather, metal, plastic, glass, wood, ceramics, or the like.

The term "liquid discharge unit" represents a structure including the liquid discharge head and a functional part(s) or mechanism integrated or united thereto. That is, "liquid discharge unit" is an assembly of parts relating to liquid discharge. For example, the liquid discharge unit (a liquid discharge device) includes a combination of the head with at least one of a head tank, a carriage, a supply device, a maintenance device, and a main scan moving unit.

Herein, the terms "integrated" or "united" mean attaching the liquid discharge head and the functional parts (or mechanism) to each other by fastening, screwing, binding, or engaging and holding one of the liquid discharge head and the functional parts movably relative to the other. The liquid discharge head may be detachably attached to the functional part(s) or unit(s).

For example, the head and the head tank are integrated as the liquid discharge device (liquid discharge unit). Alternatively, the head can be coupled with the head tank through a tube or the like, and thus the head and the head tank are united together. A unit including a filter can be added at a position between the head tank and the head of the liquid discharge device. In yet another example, the liquid discharge head and the carriage can be united as "liquid discharge device".

As yet another example, the liquid discharge device is an integrated unit in which the head and the main scanning moving unit are integrated as a single unit. The head is movably held by a guide that forms a part of the main scanning moving unit. The liquid discharge device can include the head, the carriage, and the main scan moving unit that are integrated as a single unit.

As yet another example, the liquid discharge device is an integrated unit in which a cap that forms a part of the maintenance unit is secured to the carriage mounting the head so that the head, the carriage, and the maintenance unit are integrated as a single unit.

Further, in another example, the liquid discharge device includes tubes connected to the head tank or the head mounting the channel member so that the head and the supply assembly are integrated as a single unit. Through this tube, the liquid stored in a liquid container such as an ink cartridge is supplied to the head. The main scan moving mechanism may be a guide only. The supply unit can be a tube(s) only or a loading unit only.

In the present disclosure, "image forming", "recording", "printing", "fabricating", etc. are treated as synonymous terms.

Hereinafter, an embodiment of the present invention will be specifically described with reference to the drawings. Note that suitable means and processes and the like are described below, but the present invention is not limited by the following description. In addition, all of the configurations described in the embodiment are not indispensable constituent requirements of the present invention.

In a serial type liquid discharge apparatus, while a recording medium is intermittently conveyed for each predetermined width, a liquid is repeatedly discharged onto the recording medium to form an image. In this case, when drying is performed with an electromagnetic wave, a certain position on the recording medium passes through an irradiation area of the electromagnetic wave while moving, and another position on the recording medium stops in the irradiation area of the electromagnetic wave. Therefore, the irradiation amount of the electromagnetic wave and the drying amount vary depending on a position on the recording medium disadvantageously.

FIG. 1 is a schematic view illustrating a liquid discharge apparatus according to an embodiment of the present invention. A liquid discharge apparatus 1 illustrated in FIG. 1 is a serial type inkjet recording apparatus.

The liquid discharge apparatus 1 includes a liquid discharge head 20, an encoder sensor 21, a carriage 22, a timing belt 23, a driving pulley 24, a driven pulley 25, a main scanning motor 26, a platen 27, an encoder sheet 28, a main guide rod 29, a sheet conveyor 30, and a heater H.

The main guide rod 29 supports the carriage 22 such that the carriage 22 can reciprocate in a main scanning direction (direction of arrow A in FIG. 1). The driving pulley 24 and the driven pulley 25 are disposed at predetermined intervals in the main scanning direction. The timing belt 23 is in a form of an endless belt, and is stretched between the driving pulley 24 and the driven pulley 25.

The encoder sheet 28 is disposed parallel to the timing belt 23 over a range of movement of the carriage 22. The carriage 22 includes the encoder sensor 21 to read the encoder sheet 28. The main scanning motor 26 rotationally drives the driving pulley 24 based on a reading result of the encoder sheet 28 by the encoder sensor 21. As a result, the timing belt 23 rotates and moves. The carriage 22 is connected to the timing belt 23. The timing belt 23 rotates and moves, and the carriage 22 thereby reciprocates in the main scanning direction.

The sheet conveyor 30 includes a sheet feeder 30F to feed a recording medium P and a winder 30R to wind the recording medium P. The recording medium P is intermittently conveyed on the platen 27 in a sub-scanning direction (direction of arrow B in FIG. 1) orthogonal to the main scanning direction by operation of the sheet conveyor 30. In FIG. 1, the case where the recording medium P is roll paper is illustrated. However, the recording medium P is not limited to continuous paper such as roll paper.

The liquid discharge head 20 includes a nozzle array in which a plurality of nozzles is arranged in the sub-scanning direction. The liquid discharge head 20 is mounted on the carriage 22 such that a discharge surface (nozzle surface) of each of the nozzles faces the recording medium P side. The liquid discharge head 20 discharges an ink as an example of a liquid while moving in the main scanning direction with respect to the recording medium P intermittently conveyed in the sub-scanning direction, and thereby forms an image on the recording medium P. The liquid discharge head 20 is driven at driving frequencies corresponding to three types of capacities, and thereby injects large ink droplets, medium ink droplets, or small ink droplets from each nozzle.

The liquid discharge apparatus 1 includes a plurality of liquid discharge heads 20, for example, four heads for each of four colors. In this case, in order to form a high-resolution image at a high speed, nozzles in a nozzle array in the liquid discharge head 20 may be arranged at intervals so as to be shifted from the positions of nozzles in another nozzle array in the sub-scanning direction.

In the liquid discharge head 20, inks discharged from nozzles in one nozzle array have the same color. For example, the liquid discharge head 20 includes four nozzle arrays for discharging inks of black (K), cyan (C), magenta (M), and yellow (Y), respectively.

Figure 2:
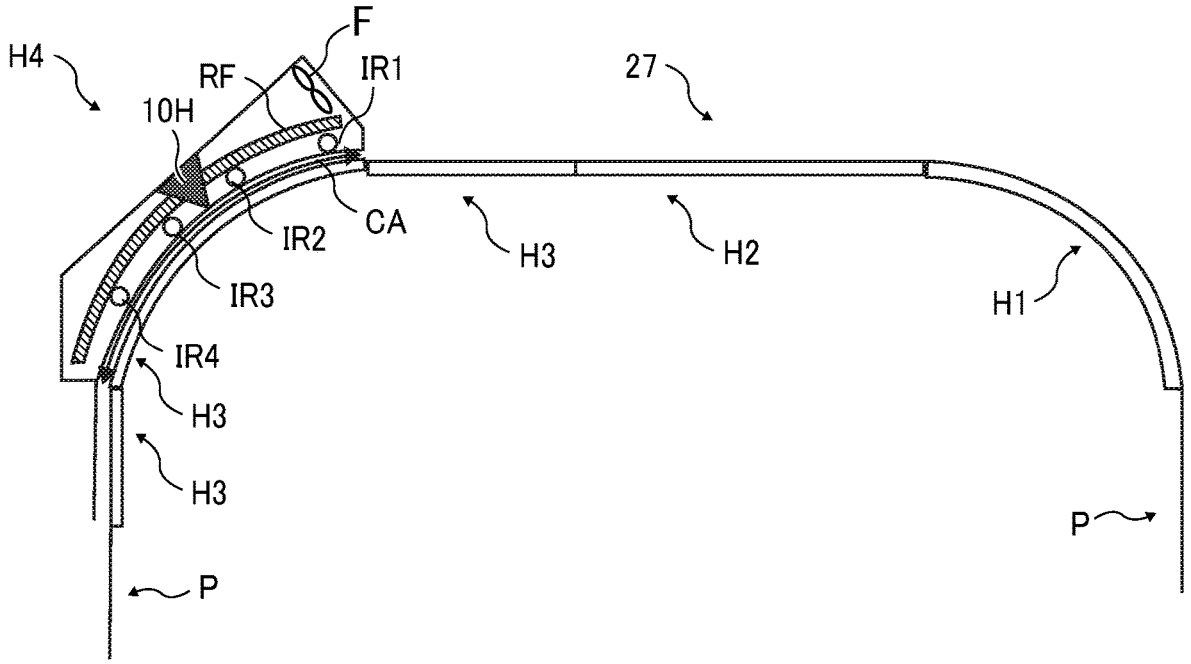
FIG. 2 is a side view of a heater disposed in the liquid discharge apparatus of FIG. 1 as viewed from a main scanning direction side.

Referring to FIGS. 1 and 2, a conveying path of the liquid discharge apparatus 1 is provided with a first heater H1 (a preheater) to heat the recording medium P conveyed to an image forming unit, a second heater H2 (a print heater) to heat the recording medium P which has been conveyed onto the platen 27 as the image forming unit, a third heater H3 (a post-heater) to heat the recording medium P which has passed through the image forming unit, and a fourth heater H4 (an irradiation device). The first heater H1, the second heater H2, the third heater H3, and the fourth heater H4 are correctively referred to as "heaters H" to heat the recording medium P. FIG. 2 is a side view of the heaters H disposed in the liquid discharge apparatus 1 of FIG. 1 as viewed from the main scanning direction side.

The first heater H1 and the third heater H3 are aluminum foil cord heaters and bonded to a back surface of a conveying guide plate in the conveying path. The second heater H2 is a code heater and embedded in the platen 27 formed of an aluminum material. The first heater H1, the second heater H2, and the third heater H3 heat a printing side of the recording medium P from the back side, that is, from the opposite side to a side onto which ink is applied.

The fourth heater H4 is disposed as an infrared (IR) heating type heater so as to face a part of the third heater H3. The fourth heater H4 heats the printing surface of the recording medium P, that is, the surface onto which an ink has been discharged. The fourth heater H4 includes, for example, a plurality of infrared heaters IR1, IR2, IR3, and IR4 coupled to each other in series. On the opposite side to the conveying path of the recording medium P with respect to the infrared heaters, a reflector RF to reflect an infrared ray emitted by the infrared heaters is disposed. The infrared heaters and the reflector RF are covered with a casing including a heat insulating material. The casing is open on the conveying path side. As a result, an infrared ray irradiation area CA by the fourth heater H4 is limited to a predetermined width of the conveyance path. Furthermore, the casing includes a fan F to suck air into the casing.

An ink landed on the recording medium P at the time of image formation is primarily dried on the heated recording medium P. Primary drying evaporates moisture of the ink and aggregates a pigment. Therefore, bleeding (color boundary bleeding) and beading (density unevenness due to uniting of dots) are reduced. The ink landed on the recording medium P is secondarily dried by the third heater H3 and the fourth heater H4. Primary drying is processed, for example, at 30° C. to 60° C., and secondary drying is processed, for example, at 70° C. to 90° C.

Note that the first heater H1, the second heater H2, and the third heater H3 may be further divided into fine parts to control the temperature of each heater H in order to reduce a heat loss.

Hardware Configuration

Figure 3:
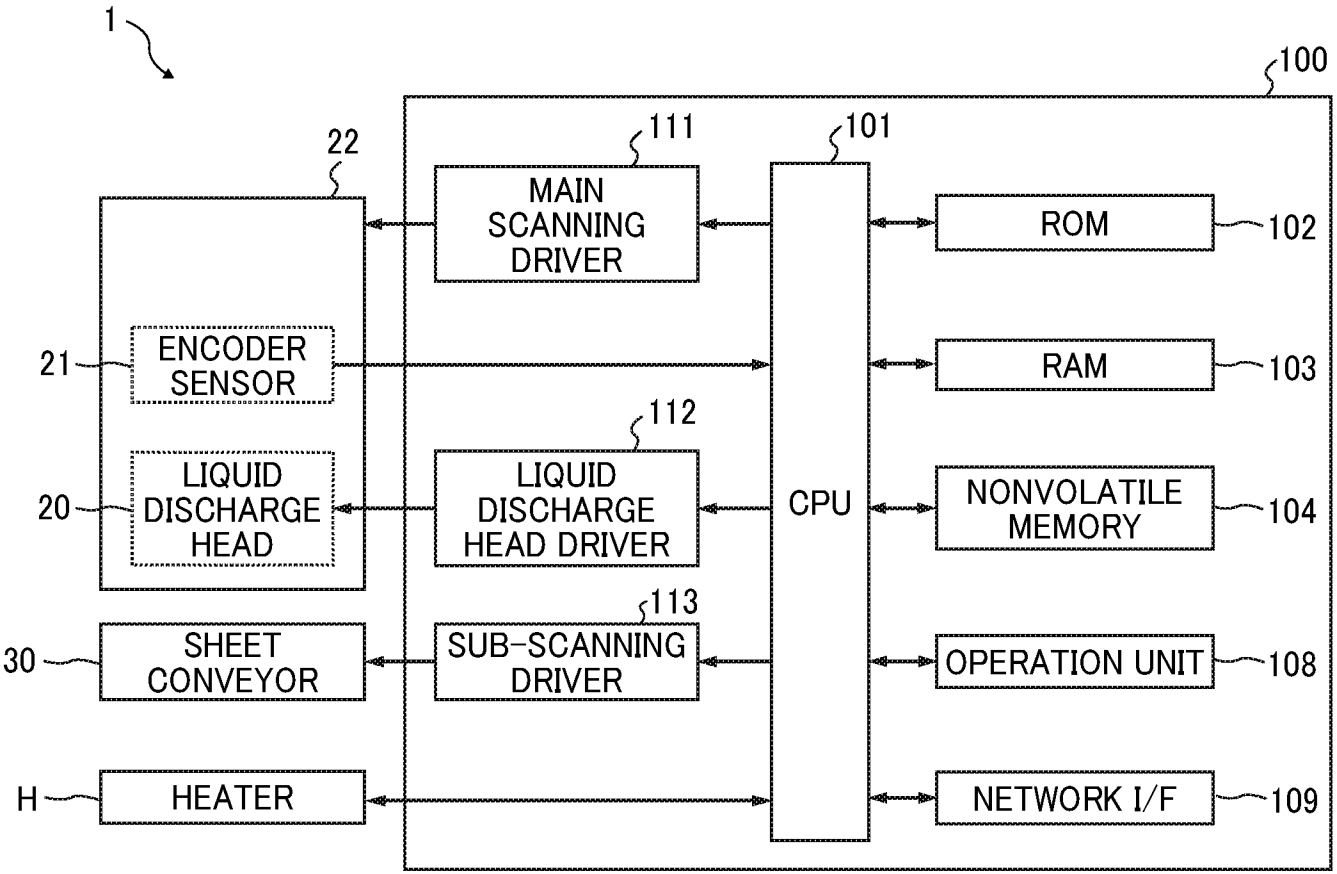
FIG. 3 is a hardware configuration diagram of a controller of a liquid discharge apparatus according to an embodiment.

FIG. 3 is a hardware configuration diagram of a controller of a liquid discharge apparatus according to an embodiment. A controller 100 of the liquid discharge apparatus 1 includes a central processing unit (CPU) 101, a read only memory (ROM) 102, a random access memory (RAM) 103, a nonvolatile memory 104, an operation unit 108, a network interface (I/F) 109, a main scanning driver 111, a liquid discharge head driver 112, and a sub-scanning driver 113. These parts are electrically connected to each other through a bus line as illustrated in FIG. 3.

The CPU 101 is a processing device for controlling the entire liquid discharge apparatus 1. The ROM 102 stores a program, system data, and the like of the liquid discharge apparatus 1. The RAM 103 is a volatile memory and develops a program stored in the ROM 102 to be used as a work area of the CPU 101. The nonvolatile memory 104 is a nonvolatile memory from which data can be read and on which data can be written, and for example, a hard disk (HD), a solid state drive (SSD), or a non-volatile RAM (NVRAM).

The operation unit 108 is, for example, an operation panel including a liquid crystal display or an organic electro luminescence (EL) display having a touch panel function, a keyboard, and the like.

The main scanning driver 111 is a circuit for transmitting a signal to the main scanning motor 26 based on a command from the CPU 101 to control movement of the carriage 22 in the main scanning direction. The liquid discharge head driver 112 is a circuit for transmitting a signal to the liquid discharge head 20 to control driving of the liquid discharge head 20. The CPU 101 inputs data indicating the position of the carriage 22 in the main scanning direction, output by the encoder sensor 21. The sub-scanning driver 113 is a circuit for transmitting a signal to the sheet conveyor 30 based on a command from the CPU 101 to control conveyance of the recording medium P in the sub-scanning direction. Each heater H includes a temperature detecting device. The CPU 101 inputs temperature data output by a temperature detecting element 10H, such as a thermopile. The CPU 101 transmits a signal to the heater H to control ON/OFF or a turning-on ratio of the heater H. Note that the main scanning driver 111, the liquid discharge head driver 112, and the sub-scanning driver 113 may be executed by a process of the CPU 101 according to a program.

Functional Configuration

Figure 4:
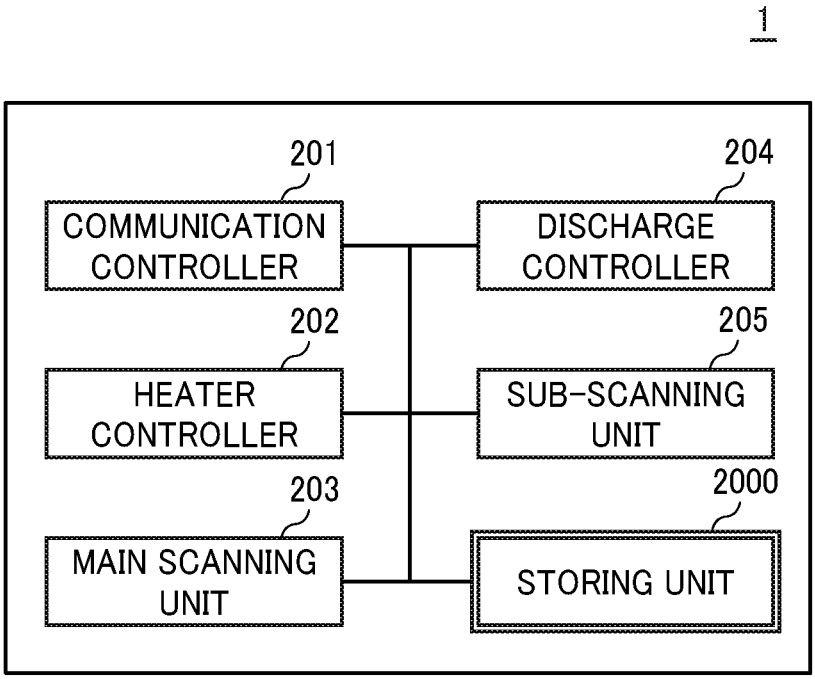
FIG. 4 is a functional block diagram of a liquid discharge apparatus according to an embodiment.

FIG. 4 is a functional block diagram of a liquid discharge apparatus according to an embodiment. The liquid discharge apparatus 1 includes a communication controller 201, a heater controller 202, a main scanning unit 203, a discharge controller 204, and a sub-scanning unit 205. Each of these units is a function implemented by operation of any one of the components illustrated in FIG. 3 by a command from the CPU 101 according to a program stored in the ROM 102. The liquid discharge apparatus 1 includes a storing unit 2000 constructed by the ROM 102 or the nonvolatile memory 104.

The communication controller 201 is implemented by a command from the CPU 101 and a process of the network I/F 109, and receives information transmitted by an external information processing apparatus.

The heater controller 202 is implemented by a command from the CPU 101, and controls a heating temperature by the heater H based on detection data sent from the temperature detecting element 10H of the heater H.

The main scanning unit 203 is implemented by a command from the CPU 101 and a process of the main scanning driver 111, and controls movement of the liquid discharge head 20 in the main scanning direction.

The discharge controller 204 is implemented by a command from the CPU 101 and a process of the liquid discharge head driver 112, and controls discharge of an ink by the liquid discharge head 20.

The sub-scanning unit 205 is implemented by a command from the CPU 101 and a process of the sub-scanning driver 113, and controls conveyance of the recording medium P in the sub-scanning direction.

Ink

Subsequently, as a liquid discharged by the liquid discharge apparatus 1, an ink, a pretreatment liquid, and a post-treatment liquid will be described. The ink contains, for example, an organic solvent, water, a coloring material, a resin, an additive, and the like.

Organic Solvent

There is no specific limitation on the type of the organic solvent. For example, water-soluble organic solvents are usable. Examples of water-soluble organic solvents include polyols, ethers (e.g., polyol alkyl ethers and polyol aryl ethers), nitrogen-containing heterocyclic compounds, amides, amines, and sulfur-containing compounds.

Water

Preferably, the content rate of water in the ink is in the range of from 10% to 90% by mass, more preferably from 20% to 60% by mass, for drying property and discharge reliability of the ink.

Colorant

Specific examples of the colorant include, but are not limited to, pigments and dyes. Usable pigments include both inorganic pigments and organic pigments. One type of pigment can be used alone, or two or more types of pigments can be used in combination. Mixed crystals may also be used. Usable pigments include black pigments, yellow pigments, magenta pigments, cyan pigments, white pigments, green pigments, orange pigments, glossy color pigments (e.g., gold pigments and silver pigments), and metallic pigments.

Resin

Specific examples the water-dispersible resins include, but are not limited to, urethane resins, polyester resins, acrylic resins, vinyl acetate resins, styrene resins, butadiene resins, styrene-butadiene resins, vinyl chloride resins, acrylic styrene resins, and acrylic silicone resins. These resins may be in the form of particles (hereinafter "resin particles"). The resin particles may be dispersed in water to become a resin emulsion. The ink can be obtained by mixing the resin emulsion with other materials such as colorant and organic solvent. The resin particles are available either synthetically or commercially. The resin particles may include one type or two or more types of resin particles.

Additives

The ink may further contain a surfactant, a defoamer, a preservative, a fungicide, a corrosion inhibitor, and/or a pH adjuster.

Pretreatment Liquid

The pretreatment liquid contains a coagulant, an organic solvent, and water, and may optionally contain a surfactant, an antifoaming agent, a pH adjusting agent, an antiseptic/antifungal agent, a rust preventive agent, and the like. As the organic solvent, the surfactant, the antifoaming agent, the pH adjusting agent, the antiseptic/antifungal agent, and the rust preventive agent, a material similar to those used for an ink can be used. In addition, a material used for a known treatment liquid can be used. The type of the coagulant is not particularly limited, and examples thereof include a water-soluble cationic polymer, an acid, and a polyvalent metal salt.

Process

Subsequently, a process in the liquid discharge apparatus 1 will be described. First, a method for setting a heating temperature by the heater H of the liquid discharge apparatus 1 will be described.

In an embodiment, a heating temperature by each heater H (the first heater H1, the second heater H2, the third heater H3, and the fourth heater H4) is set using a job management software in an external information processing apparatus. In this case, setting of the heating temperature by the heater H is input from the external information processing apparatus to the liquid discharge apparatus 1 via the communication controller 201. Alternatively, the operation unit 108 of the liquid discharge apparatus 1 can receive an input of setting of the heating temperature of the heater H directly from a user. In this case, the liquid discharge apparatus 1 can give priority to setting directly input over setting input from the external information processing apparatus.

Setting of the heater H includes information indicating whether to turn ON or OFF for each heater H and a set temperature for each heater H. An initial value of setting of the heater H may be OFF. In a case where setting of the heater H is ON, a receivable temperature range includes, for example, a temperature ascending from 20° C. to 80° C. by a unit of 1° C. In setting the fourth heater H4, a receivable temperature range is, for example, a temperature higher than a temperature set by the third heater H3 by 0° C. to 25° C., preferably by 0° C. to 20° C. Received setting of the heater H is stored in the storing unit 2000 by the heater controller 202. Note that the storing unit 2000 may be constructed by the nonvolatile memory 104. In this case, setting is held even after a power supply of the liquid discharge apparatus 1 is cut off.

Figure 5:
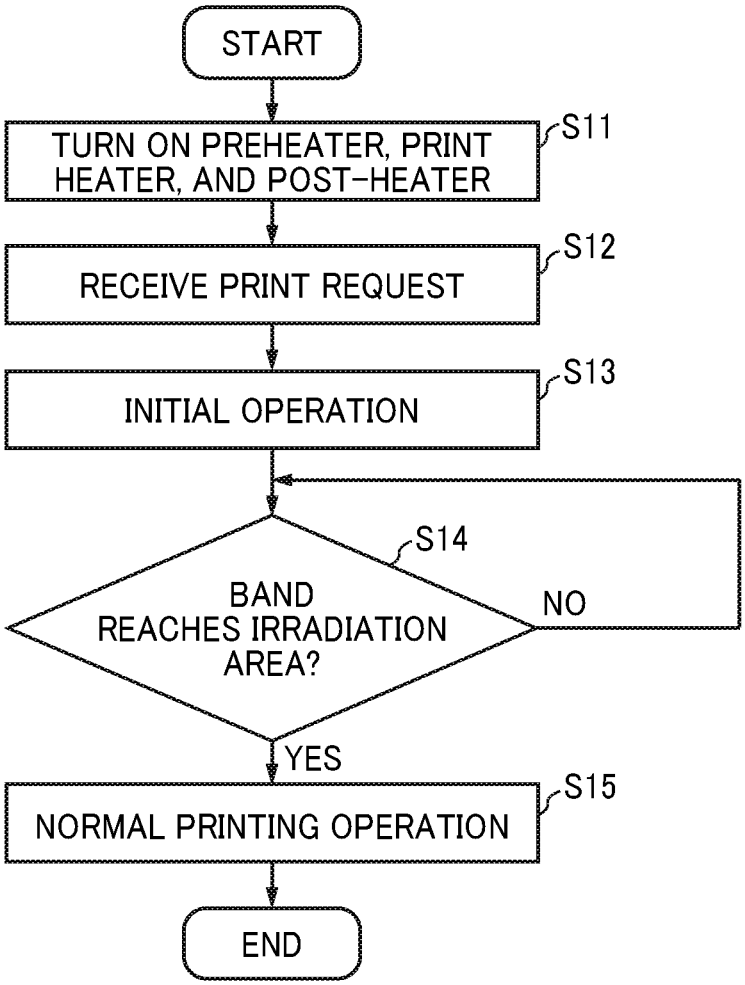
FIG. 5 is a flowchart illustrating an example of a process of forming an image.
Figure 6:
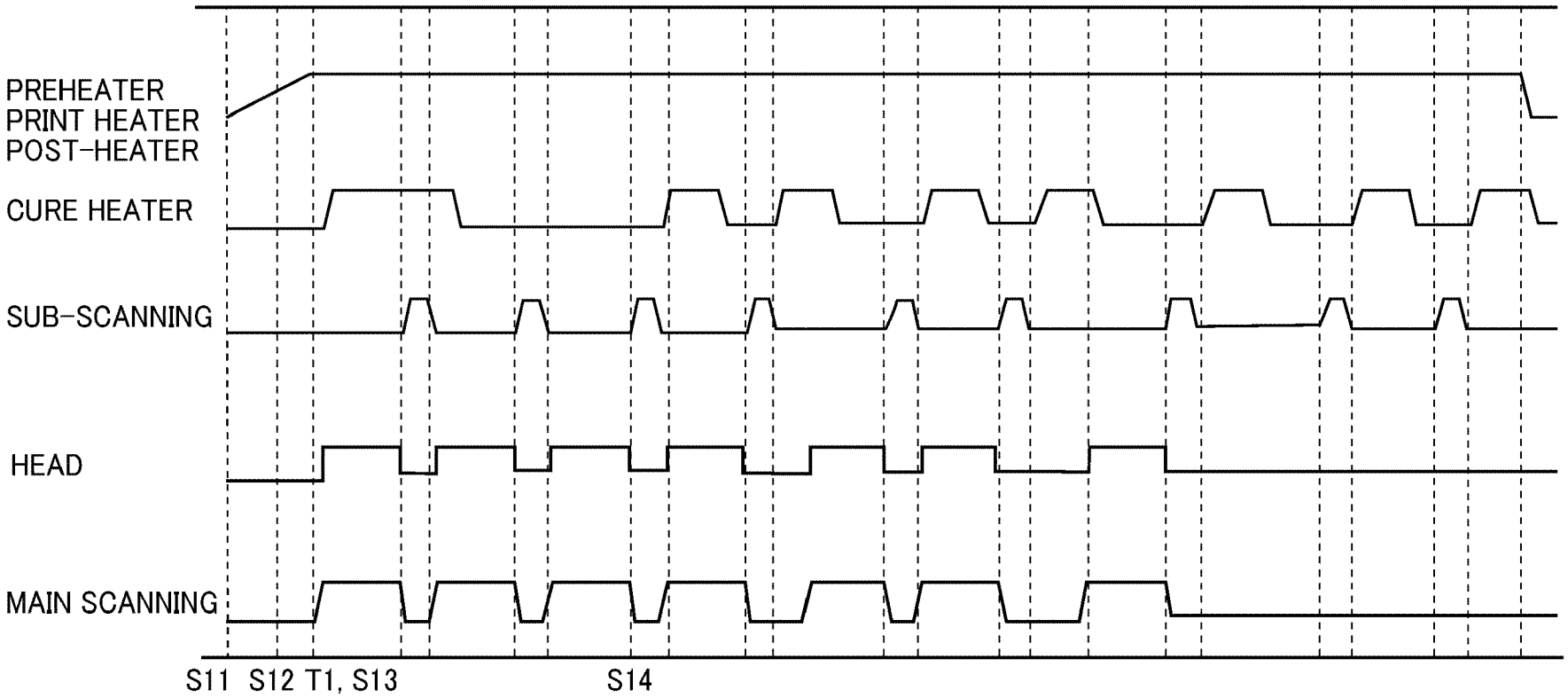
FIG. 6 is an example of a timing chart illustrating an output by each hardware in an image forming apparatus.

FIG. 5 is a flowchart illustrating an example of a process of forming an image. FIG. 6 is an example of a timing chart illustrating an output by each hardware in the liquid discharge apparatus 1. Subsequently, a process of forming an image will be described.

When the liquid discharge apparatus 1 returns from a sleep mode, the heater controller 202 turns ON the first heater H1 (preheater), the second heater H2 (print heater), and the third heater H3 (post-heater), and performs control such that a heating temperature by each heater H is a set temperature stored in the storing unit 2000 (step S11).

The heater controller 202 switches each heater H between ON and OFF or changes a turning-on ratio (duty cycle) of each heater H in a predetermined time unit (control cycle) such as 100 ms or 1000 ms, which can be stored in a memory, for example, by a manufacturer based on empirical data. The heater controller 202 may switch each heater H between ON and OFF by soft start or stop.

An output portion of each heater H includes the temperature detecting element 10H such as a thermistor or a thermopile. The thermopile is an electric component to convert thermal energy into electric energy. The thermistor is a resistor that significantly changes in electrical resistance in response to a temperature change. A cycle in which the heater controller 202 acquires an output obtained by AD conversion of feedback of the temperature detecting element 10H as detection data is represented as a detection cycle. The heater controller 202 performs an arithmetic process on a plurality of detection data to convert the detection data into data for temperature control. The resulting data is referred to as a "control use temperature". A cycle for determining the control use temperature is referred to as a "temperature detection cycle".

The detection cycle in a case of using a thermistor as the temperature detecting element 10H is, for example, 100 ms, and the detection cycle in a case of using a thermopile is, for example, 10 msec. For example, the heater controller 202 removes upper and lower four points among 10 points as detection data and averages the remaining six points to obtain the control use temperature. In this case, the temperature detection cycle in a case of using a thermistor is 1000 ms, and the temperature detection cycle in a case of using a thermopile is 100 msec.

If a set temperature is higher than the control use temperature, the heater controller 202 controls the heater H to be ON. If the set temperature is lower than the control use temperature, the heater controller 202 controls the heater H to be OFF.

The heater controller 202 may control the heating temperature of the heater H according to a turning-on ratio (duty). In this case, the heater controller 202 sets an upper margin and a lower margin with respect to a set temperature. In the first heater H1 and the third heater H3, the upper margin is, for example, 2° C., and the lower margin is, for example, 0° C. In the second heater H2 and the fourth heater H4, the upper margin is, for example, 0.5° C., and the lower margin is, for example, 0.5° C. In a case where the upper margin and the lower margin are each 0.5° C., if a set temperature is 70° C., a heater is controlled to be ON until a detection temperature of a thermistor reaches 69.5° C. When the temperature exceeds 70.5° C., the heater is controlled to be OFF. When the temperature drops to 69.4° C. again, the heater is controlled to be ON.

The heater controller 202 compares the current temperature (control use temperature) with the set temperature, and determines a turning-on ratio (duty) according to one of the following formulas:

Control use temperature≥(set temperature+upper margin):duty=0%

Control use temperature≤(set temperature−lower margin):duty=100%

(Target temperature−lower margin)<current temperature<(target temperature+upper margin):duty calculated in the previous determination is continuously used.

Incidentally, when switching is performed immediately after start of control from other control, the heater controller 202 sets Duty to 0%.

Figure 7:
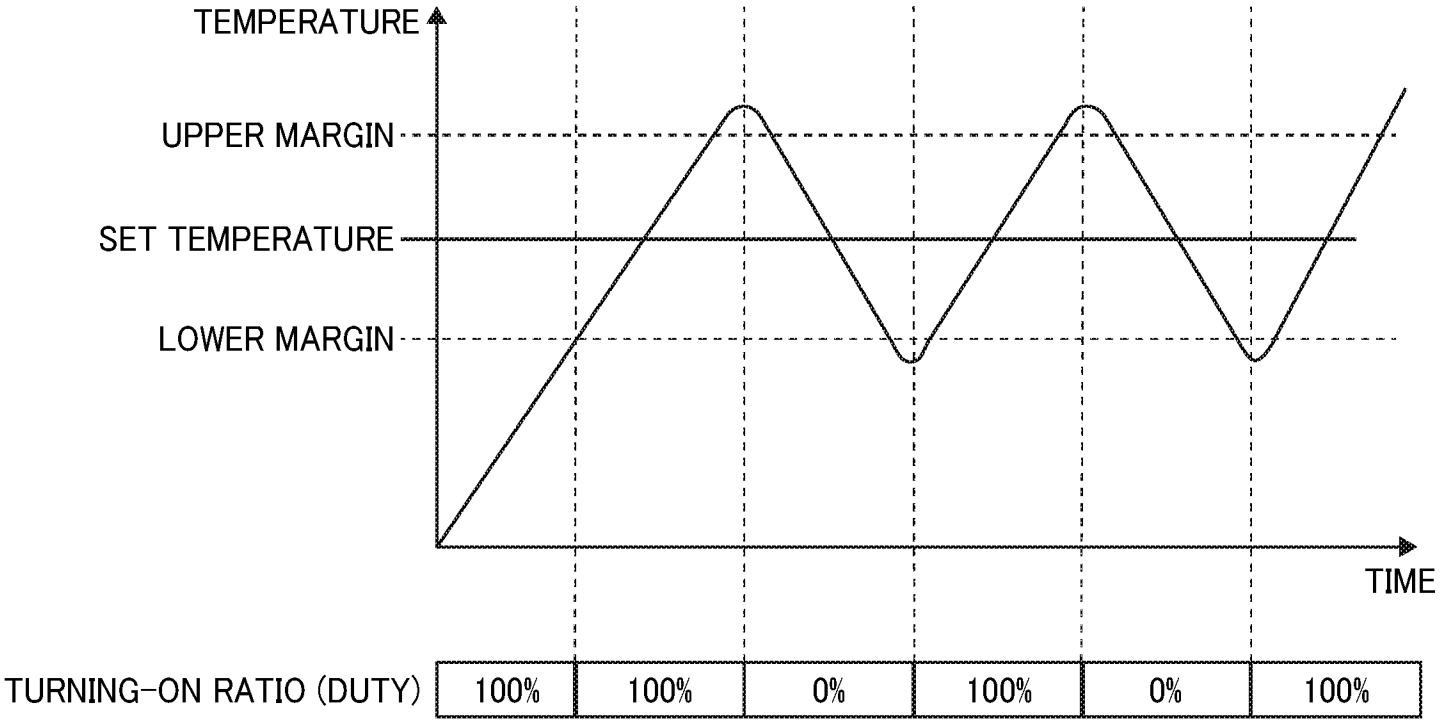
FIG. 7 is a graph illustrating an example of a relationship between time and the temperature of a recording medium.

FIG. 7 is a graph illustrating an example of a relationship between time and the temperature of a recording medium in a case where the above temperature control is executed. Below the graph, a turning-on ratio (duty) of the heater H for each control cycle is illustrated.

Note that the method for controlling the heating temperature of the heater H is not limited to the above. For example, the heater controller 202 may detect an input voltage of a signal transmitted between hardware of the liquid discharge apparatus 1 and may execute exclusive control of the heater H according to the state of the liquid discharge apparatus 1.

At an arbitrary timing after the liquid discharge apparatus 1 returns from a sleep mode, an external information processing apparatus transmits a print request including image data to the liquid discharge apparatus 1. The communication controller 201 of the liquid discharge apparatus 1 receives the print request transmitted by the external information processing apparatus (step S12).

At a timing (T1) when the heating temperature by each of the first heater H1, the second heater H2, and the third heater H3 reaches a set temperature, the liquid discharge apparatus 1 starts an initial printing operation (step S13). The initial printing operation includes a printing process, a process of conveying the recording medium P, and preliminary heating of the fourth heater H4.

The printing process in the first pass of the initial operation is executed with the timing (T1) as a trigger. The printing processes in the second and subsequent passes are executed with stop of conveyance of the recording medium P in the sub-scanning direction as a trigger. However, for example, in a case where maintenance or the like of the liquid discharge head 20 is executed, exceptionally, the printing process is restarted at a predetermined timing. The printing process includes a head conveying process to convey the liquid discharge head 20 in the main scanning direction by the main scanning unit 203, and a discharge process of discharging an ink from a nozzle in a nozzle array by the discharge controller 204 while the liquid discharge head 20 is conveyed in the main scanning direction.

Figure 8:
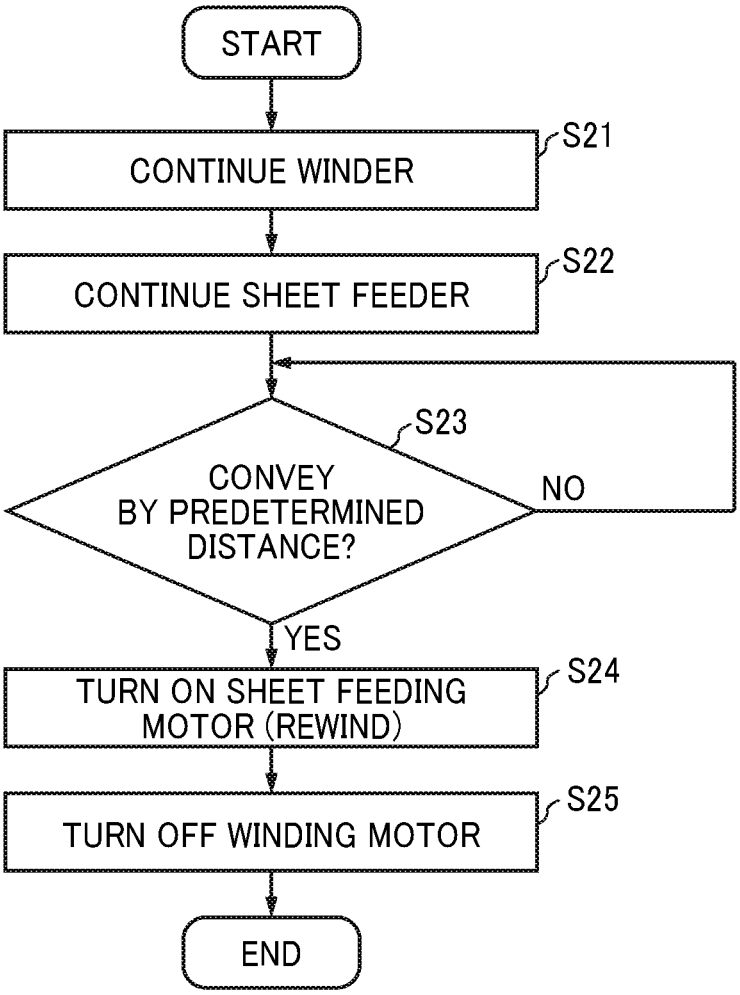
FIG. 8 is a flowchart illustrating an example of a process of conveying a recording medium.

FIG. 8 is a flowchart illustrating an example of a process of conveying the recording medium P. With reference to FIG. 8, the process of conveying the recording medium P in the initial operation will be described. The sub-scanning unit 205 continuously operates the winder 30R with stop of movement of the liquid discharge head 20 in the main scanning direction as a trigger (step S21). By continuously operating the winder 30R with the sheet feeder 30F stopped, tension is applied to the recording medium P. In a case where a fan to suck the recording medium P is disposed on the platen 27, the sub-scanning unit 205 continuously operates the fan. Subsequently, the sub-scanning unit 205 continuously operates the sheet feeder 30F (step S22). As a result, the recording medium P is conveyed in the sub-scanning direction.

The sub-scanning unit 205 waits until the recording medium P is conveyed by a bandwidth (to be described later with reference to FIG. 9) as a predetermined distance (NO in step S23).

If the recording medium P is conveyed by the bandwidth (YES in step S23), the sub-scanning unit 205 turns on a sheet feeding motor to reverse the direction of a paper feeding roller in the sheet feeder 30F in a rewinding direction (step S24)

Subsequently, the sub-scanning unit 205 turn off a winding motor to stop the operation of the winder 30R (step S25). As a result, conveyance of the recording medium P is stopped in a state in which tension is applied.

Figure 9:
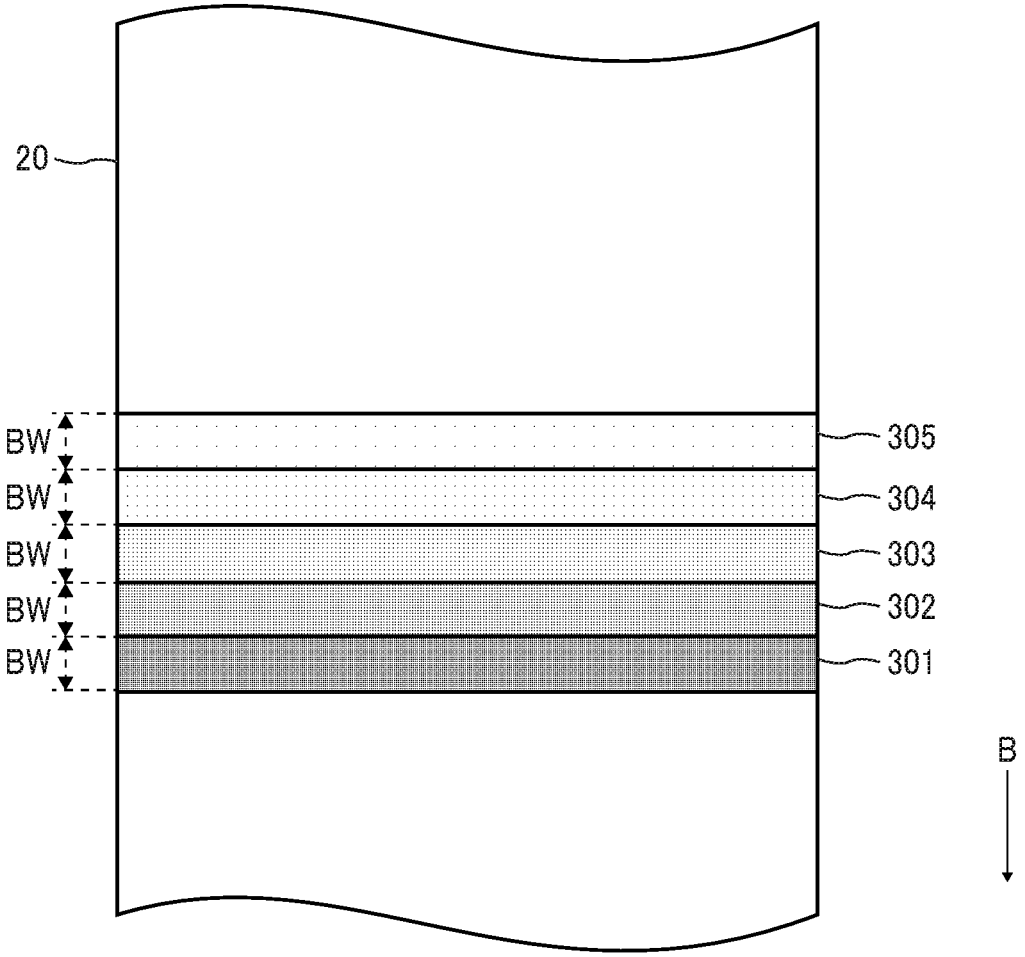
FIG. 9 is a top view illustrating an example of a printing state when printing is performed by a multi-pass method.
Figure 10:
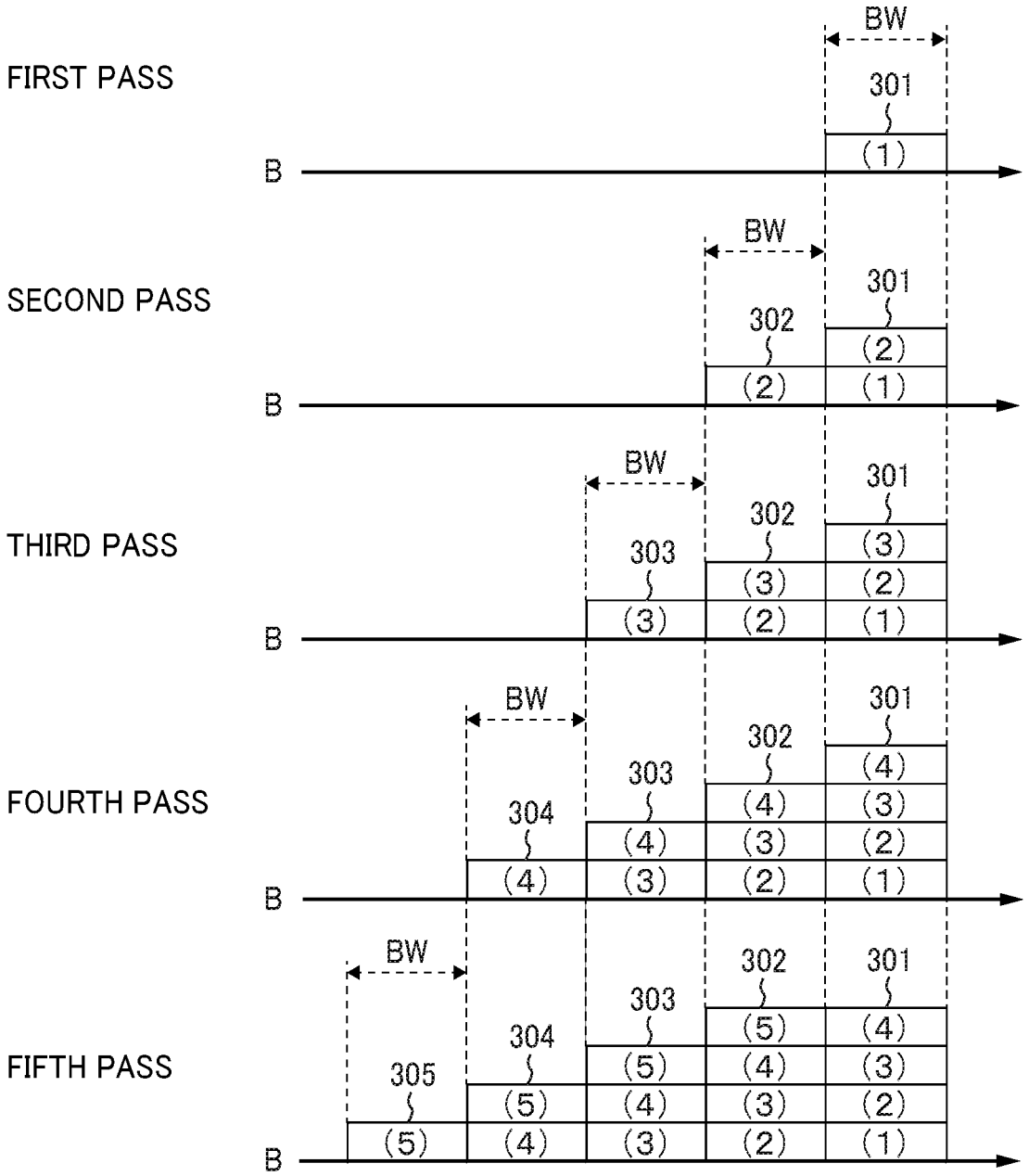
FIG. 10 is a side view illustrating a cross-sectional structure in the printing state illustrated in FIG. 9.

Every time the process of conveying the recording medium P is executed, the recording medium P is intermittently conveyed in the sub-scanning direction by the bandwidth. Then, the printing process and the process of conveying the recording medium P are repeated sequentially to form an image in a bandwidth region on the recording medium P. FIG. 9 is a top view illustrating an example of a printing state when printing is performed by a multi-pass method; FIG. 10 is a side view illustrating a cross-sectional structure in the printing state illustrated in FIG. 9. In FIG. 10, a rectangle indicates a deposit of an ink, and a numeral in the rectangle indicates the number of a pass in which the deposit has been formed. Note that FIG. 9 illustrates an image formed by repeating the printing process five times on the recording medium P in a printing mode to complete an image in four passes.

In the printing process in the first pass, while the main scanning unit 203 moves the liquid discharge head 20 in the main scanning direction, the discharge controller 204 causes a nozzle located at a position of ¼ from an upstream end with respect to the conveying path in a nozzle array of the liquid discharge head 20 to discharge an ink droplet. As a result, on the recording medium P, a band 301 having a bandwidth BW corresponding to a ¼ length of the nozzle array is formed. After the printing process in the first pass, the sub-scanning unit 205 conveys the recording medium P in the sub-scanning direction by the bandwidth BW.

In each of the printing processes in the second and third passes, a similar process to the printing process in the first pass is executed except that an ink droplet is discharged from a nozzle located at a position of ⅔ or ¾ from the upstream end with respect to the conveying path in a nozzle array of the liquid discharge head 20. In the printing processes in the fourth pass and subsequent passes, a similar process to the printing process in the first pass is executed except that an ink droplet is discharged from all the nozzles in a nozzle array of the liquid discharge head 20. When the printing process in the fifth pass is completed, the recording medium P obtains an image in which the bands 301, 302, 303, and 304 are formed as illustrated in FIGS. 9 and 10.

It takes several tens of seconds for the band 301 formed in the first pass in the initial operation to reach the infrared ray irradiation area CA by the fourth heater H4. Preliminary heating of the fourth heater H4 is executed at an arbitrary timing after the initial operation is started and before the band 301 reaches the irradiation area CA.

Preliminary heating of the fourth heater H4 is a process of turning on an infrared heater of the fourth heater H4 to heat a filament of the infrared heater to a predetermined temperature such that the filament emits an electromagnetic wave having a predetermined wavelength. Note that the wavelength of an infrared ray emitted by the fourth heater H4 depends on the temperature of the filament of the infrared heater of the fourth heater H4 as illustrated in the following formula.

$$\text{Peak wavelength (cm)} = 0.29/T \text{(displacement rule of Wien)}$$

where T in the formula is an absolute temperature. By executing preliminary heating of the fourth heater H4 in the initial operation without executing the preliminary heating at the same time as returning from the sleep mode, it is possible to prevent deterioration of the recording medium P due to unnecessary radiation heating of the recording medium P.

Here, the electromagnetic wave includes a wavelength other than an infrared ray and includes, for example, a high-frequency wave from a high-frequency dielectric heater and a micro wave from a microwave heater.

The fourth heater H4 includes a thermopile as a temperature detecting element to detect a heating temperature by an infrared heater for each infrared heater. The heater controller 202 controls ON/OFF of the infrared heater based on a detection result by the thermopile. The thermopile outputs a temperature ($V_{obj}$) of a surface of the recording medium P and a temperature ($V_{tamb}$) of the thermopile. The temperature of the recording medium P is obtained by converting the temperatures ($V_{obj}$ and $V_{tamb}$) based on a predetermined conversion table.

In preliminary heating, a method for controlling the heating temperature by the fourth heater H4 to a set temperature by the heater controller 202 is similar to a method for controlling the heating temperature by the first heater H1, the second heater H2, and the third heater H3 to a set temperature. In this case, the heater controller 202 sets an upper margin of the fourth heater H4 to, for example, 0.5° C. and sets a lower margin of the fourth heater H4 to, for example, 0.5° C.

If the band 301 formed in the first pass of the initial operation reaches the irradiation area CA (YES in step S14), the liquid discharge apparatus 1 proceeds to a normal printing operation (step S15). The normal printing operation includes a printing process, a process of conveying the recording medium P, and an irradiation process by the fourth heater H4.

The printing process in the normal printing operation is similar to the printing processes in the fourth pass and subsequent passes in the initial operation. That is, while the main scanning unit 203 moves the liquid discharge head 20 in the main scanning direction, the discharge controller 204 discharges an ink droplet from a nozzle in a nozzle array of the liquid discharge head 20.

The process of conveying the recording medium P in the normal printing operation is similar to the process of conveying the recording medium P in the initial operation. That is, the sub-scanning unit 205 conveys the recording medium P in the sub-scanning direction by the bandwidth BW with stop of movement of the liquid discharge head 20 as a trigger.

The irradiation process by the fourth heater H4 in the normal printing operation is executed with stop of movement of the liquid discharge head 20 as a trigger. If the heater controller 202 detects stop of a drive signal output from the liquid discharge head driver 112, the heater controller 202 turns ON the fourth heater H4 for a predetermined time to dry the recording medium P to which an ink is attached. The predetermined time is shorter than the time during which the recording medium P is stopped in intermittent conveyance. The predetermined time can be stored in a memory, for example, by a manufacturer based on empirical data.

In a case where the liquid discharge apparatus 1 performs a process in a mode such as 1-pass printing in which the recording medium P is conveyed at a constant speed, even if the fourth heater H4 is turned ON all the time, period (residence time) during which the recording medium P stays in the irradiation area CA does not depend on a position on the recording medium P. However, in a case where the liquid discharge apparatus 1 performs a process in multi-pass printing in which the recording medium P is intermittently conveyed, if the fourth heater H4 is turned ON all the time, the period during which the recording medium is heated in the irradiation area CA depends on the position on the recording medium P. Specifically, a part of the recording medium P stays and heated in the irradiation area CA while sheet conveyance is stopped, but another part of the recording medium P passes through the irradiation area CA while the recording medium P is being conveyance. Therefore, the residence time of the recording medium P in the irradiation area CA varies depending on a position on the recording medium P.

When the residence time in the irradiation area CA varies depending on a position on the recording medium P, drying unevenness occurs. In a portion where the recording medium P is insufficiently dried, fastness is lowered to reduce scratch resistance due to drying failure of an ink. When the recording medium P is wound, the ink is stripped off to cause blocking on a back surface of the recording medium P to be laminated. In a portion excessively dried on the recording medium P, air in the ink is heated and expanded to generate a blister, or the recording medium P undulates due to thermal expansion to cause cockling.

When the fourth heater H4 is turned ON all the time, excessive energy is supplied to the recording medium P to induce cockling or waste energy. According to the present embodiment, drying unevenness can be prevented by turning ON the fourth heater H4 for a predetermined time in synchronization with the intermittent conveyance of the recording medium P. Therefore, improvement in quality of the recording medium P and improvement in energy saving can be achieved. In addition, the fourth heater H4 is preferably turned ON at the time of stopping rather than at the time of conveyance moving because irradiation time is longer and drying efficiency is better. However, if the irradiation amount (first irradiation amount) during stop of conveyance is larger than the irradiation amount (second irradiation amount) during conveyance, the fourth heater H4 may be controlled to be ON at the time of conveyance moving.

Table 1 illustrates infrared ray irradiation time of each part of the recording medium P in the liquid discharge apparatus 1 in which a width (distance) of the irradiation area CA of the fourth heater H4 in the sub-scanning direction is set to be half time to three times the minimum number of passes in multi-pass printing, that is, a maximum bandwidth BW in a printing mode. The recording medium P is sent by the bandwidth BW in 0.2 seconds in the sub-scanning direction and is irradiated with an infrared ray while the recording medium P stops for one second. The liquid discharge apparatus 1 in which the irradiation area CA is three times the bandwidth is irradiated with an infrared ray for three seconds at any position on the recording medium P. Similarly, the liquid discharge apparatus 1 in which the irradiation area CA is twice or one time the bandwidth is irradiated with an infrared ray for two or one second at any position on the recording medium P.

TABLE 1

| Irradiation Area | | | | | | |
|---|---|---|---|---|---|---|
| Three Times Bandwidth | 3 | | 3 | | 3 | |
| Two Times Bandwidth | 2 | | 2 | | 2 | |
| 1.5 Times Bandwidth | 2 | 1 | 2 | 1 | 2 | 1 |
| Same as Bandwidth | 1 | | 1 | | 1 | |
| Half the Bandwidth | 1 | 0 | 1 | 0 | 1 | 0 |
| | BW | | BW | | BW | |

In the liquid discharge apparatus 1 in which the irradiation area CA is 1.5 times or 0.5 times the bandwidth, the irradiation time of an infrared ray varies depending on a position on the recording medium P. In such a case, for example, the number of infrared heaters to be turned on is changed among the infrared heaters of the fourth heater H4 to change an irradiation width, and the maximum bandwidth is adjusted so as to be an integral multiple of the irradiation area of the fourth heater H4.

In this manner, in the liquid discharge apparatus 1 of the present embodiment, the width of the irradiation area CA of the fourth heater H4 in the sub-scanning direction is adjusted so as to be an integral multiple of the minimum number of passes in multi-pass printing, that is, a maximum bandwidth BW in a printing mode. As a result, irrespective of which printing mode is selected, the recording medium P is uniformly irradiated with an infrared ray.

In addition to feedback (FB) control for maintaining a heating temperature at a set temperature, the heater controller 202 executes feedforward (FF) control for adjusting a setting timing with respect to the fourth heater H4. A method for performing FB control on the fourth heater H4 is similar to a method for performing FB control on the first heater H1, the second heater H2, and the third heater H3. In this case, the temperature detecting element of the fourth heater H4 only needs to be disposed at a position capable of detecting the temperature of the recording medium P passing through the irradiation area CA.

In FF control, a turning-on timing of the fourth heater H4 is predetermined in accordance with a printing mode. In printing with a small number of multi-passes, the bandwidth is large. Therefore, a part of the recording medium P may pass through the irradiation area CA by the fourth heater H4 without being irradiated with an infrared ray. Therefore, while the intermittently conveyed recording medium P stops in the irradiation area CA, the heater controller 202 irradiates the recording medium P with an infrared ray for a predetermined irradiation time according to the number of multi-passes. Table 2 illustrates an example of a relationship between the number of multi-passes and turning-on timing in each FF control. Incidentally, in Table 2, ON indicates that the fourth heater H4 is turned ON and OFF indicates that the fourth heater H4 is turned OFF.

TABLE 2

| | PRINT MODE (PASS) | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|---|
| FF1 | 2 | ON | OFF | | | | | | | | | | | | | | |
| | 4 | ON | OFF | ON | OFF | | | | | | | | | | | | |
| | 6 | ON | OFF | ON | OFF | ON | OFF | | | | | | | | | | |
| | 8 | ON | OFF | ON | OFF | ON | OFF | ON | OFF | | | | | | | | |
| | 12 | ON | OFF | ON | OFF | ON | OFF | ON | OFF | ON | OFF | ON | OFF | | | | |
| | 16 | ON | OFF | ON | OFF | ON | OFF | ON | OFF | ON | OFF | ON | OFF | ON | OFF | ON | OFF |
| FF2 | 2 | ON | ON | | | | | | | | | | | | | | |
| | 4 | ON | ON | ON | OFF | | | | | | | | | | | | |
| | 6 | ON | ON | ON | OFF | ON | OFF | | | | | | | | | | |
| | 8 | ON | ON | ON | OFF | ON | OFF | ON | OFF | | | | | | | | |
| | 12 | ON | ON | ON | OFF | ON | OFF | ON | OFF | ON | OFF | ON | OFF | | | | |
| | 16 | ON | ON | ON | OFF | ON | OFF | ON | OFF | ON | OFF | ON | OFF | ON | OFF | ON | OFF |
| FF3 | 2 | ON | ON | | | | | | | | | | | | | | |
| | 4 | ON | ON | ON | ON | | | | | | | | | | | | |
| | 6 | ON | ON | ON | ON | ON | OFF | | | | | | | | | | |
| | 8 | ON | ON | ON | ON | ON | OFF | ON | OFF | | | | | | | | |
| | 12 | ON | ON | ON | ON | ON | OFF | ON | OFF | ON | OFF | ON | OFF | | | | |
| | 16 | ON | ON | ON | ON | ON | OFF | ON | OFF | ON | OFF | ON | OFF | ON | OFF | ON | OFF |
| FF4 | 2 | ON | ON | | | | | | | | | | | | | | |
| | 4 | ON | ON | ON | ON | | | | | | | | | | | | |
| | 6 | ON | ON | ON | ON | ON | ON | | | | | | | | | | |

TABLE 2-continued

| | PRINT MODE (PASS) | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|---|
| | 8 | ON | ON | ON | ON | ON | ON | ON | OFF | | | | | | | | |
| | 12 | ON | ON | ON | ON | ON | ON | ON | OFF | ON | OFF | ON | OFF | | | | |
| | 16 | ON | ON | ON | ON | ON | ON | ON | OFF | ON | OFF | ON | OFF | ON | OFF | ON | OFF |
| FF5 | 2 | ON | ON | | | | | | | | | | | | | | |
| | 4 | ON | ON | ON | ON | | | | | | | | | | | | |
| | 6 | ON | ON | ON | ON | ON | ON | | | | | | | | | | |
| | 8 | ON | ON | ON | ON | ON | ON | ON | ON | | | | | | | | |
| | 12 | ON | ON | ON | ON | ON | ON | ON | ON | ON | OFF | ON | OFF | | | | |
| | 16 | ON | ON | ON | ON | ON | ON | ON | ON | ON | OFF | ON | OFF | ON | OFF | ON | OFF |

Incidentally, in a case where a printing mode not listed in Table 2 is selected, the heater controller 202 may execute FB control in the irradiation process.

Figure 11:
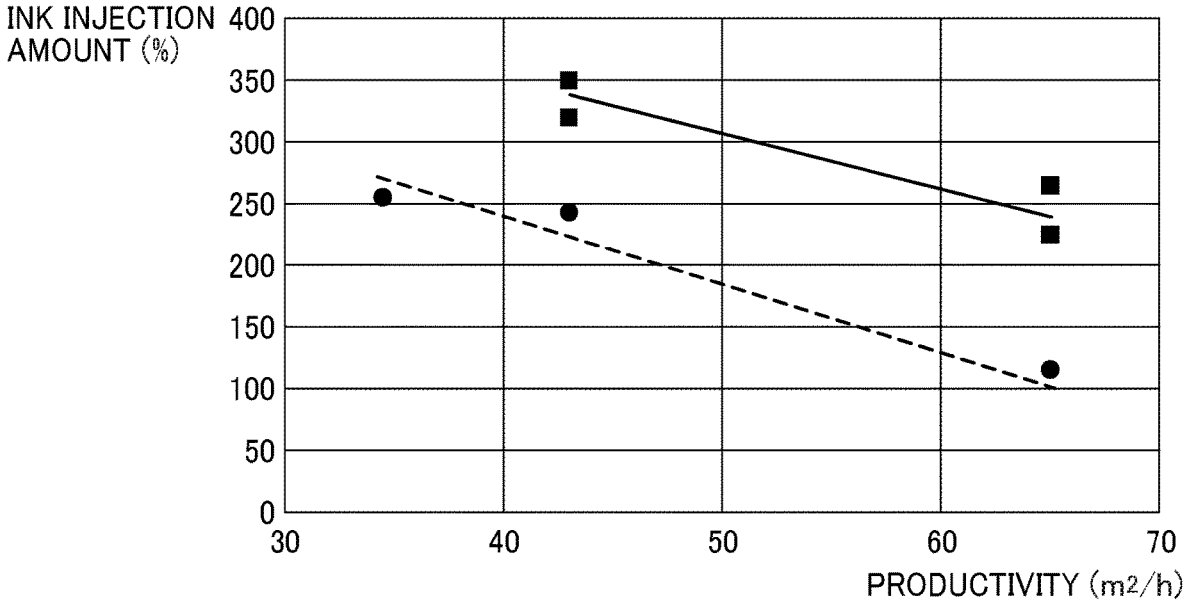
FIG. 11 is a graph illustrating a correlation between an ink injection amount and productivity.

FIG. 11 is a graph illustrating a correlation between an ink injection amount and productivity. The horizontal axis represents productivity ($m^2$/h), and the vertical axis represents an ink injection amount (%). The ink injection amount indicates a ratio (%) of an area covered with an ink in a unit area. For example, in a case where a plurality of colors of inks is discharged onto the same pixel, the ink injection amount may exceed 100%. In the graph of FIG. 11, the solid line indicates an evaluation result in an image forming method of the present embodiment in which turning-on of the fourth heater H4 and a sub-scanning timing of the recording medium P are synchronized with each other. The broken line indicates an evaluation result in a conventional image forming method in which turning-on of the fourth heater H4 and a sub-scanning timing of the recording medium P are not synchronized with each other.

As illustrated in the graph of FIG. 11, according to the image forming method of the present embodiment, higher productivity can be obtained as compared with the conventional image forming method. According to the present embodiment, even in a draft (4-pass printing) mode, a super draft (2-pass printing) mode, or a hyper draft (1-pass printing) mode with high productivity, any portion of the recording medium P stops once or more in the irradiation area CA. That is, according to the present embodiment, even in a printing mode with high productivity, drying unevenness does not occur, and an image with good quality can be obtained.

Modification A of Embodiment

A difference of Modification A from the above embodiment will be described.

A wavelength effective for evaporating water contained in an ink is different from a wavelength effective for evaporating an organic solvent. For example, a resonance wavelength of a water molecule contained in an ink is a multiple of 3 μm, and a resonance wavelength of an organic solvent is a multiple of 4 μm.

For an infrared heater of the present modification, for example, a filament capable of emitting a far infrared ray having a wavelength of 3 μm to 10 μm is used. The heater controller 202 controls each input voltage of a plurality of filaments in the fourth heater H4 to adjust the temperature of each filament. As a result, for example, the heater controller 202 controls a peak wavelength of an irradiation electromagnetic wave of a filament on an upstream side of a conveying path of the recording medium P in the fourth heater H4 to 3 μm (temperature 700° C.) effective for evaporating water, and controls a peak wavelength of an irradiation electromagnetic wave of a filament on a downstream side to 4 μm (temperature 450° C.) effective for evaporating a solvent. As a result, in the irradiation process, first, moisture of an ink is evaporated to form a film on a surface of the ink, and then a solvent can be evaporated.

Modification B of Embodiment

Subsequently, a difference of Modification B from the above embodiment will be described. The communication controller 201 of the liquid discharge apparatus 1 receives an input of information indicating the type of ink to be discharged. The heater controller 202 controls a temperature of preliminary heating of a filament such that an electromagnetic wave having a wavelength corresponding to information indicating the input type of ink is emitted. For example, a metallic ink contains a pigment component of a metal, and has a shorter resonance wavelength than another ink. In a case where information indicating the type of metallic ink is input, the heater controller 202 sets a long time for preliminary heating or sets a high input voltage of a filament to set a high temperature of the filament. As a result, an infrared ray having a short wavelength is emitted from the filament.

Modification C of Embodiment

Subsequently, a difference of Modification C from the above embodiment will be described. In Modification C of the embodiment, an external information processing apparatus receives setting of drying strength from a user using a job management software. The set drying strength is input from the information processing apparatus to the liquid discharge apparatus 1 via the communication controller 201. The storing unit 2000 of the liquid discharge apparatus 1 manages a table in which drying strength, irradiation time, and a wavelength are associated with each other.

In the irradiation process in the normal printing operation (step S15), the heater controller 202 of the liquid discharge apparatus 1 reads irradiation time and a wavelength corresponding to setting of drying strength from the storing unit 2000, and controls the fourth heater H4 such that the fourth heater H4 emits an infrared ray having the read wavelength for the read irradiation time. According to Modification C of the embodiment, the liquid discharge apparatus 1 can dry the recording medium P according to set drying strength.

Modification D of Embodiment

The storing unit 2000 of the liquid discharge apparatus 1 manages a table in which the amount of droplets to be discharged and irradiation time are associated with each other. The discharge controller 204 of the liquid discharge apparatus 1 determines the amount of droplets to be discharged based on image data included in a print request.

In the irradiation process of the normal printing operation (step S15), the heater controller 202 of the liquid discharge apparatus 1 reads irradiation time corresponding to the amount of droplets determined by the discharge controller 204 from the storing unit 2000, and turns ON the fourth heater H4 for the read time. According to Modification D of the embodiment, the liquid discharge apparatus 1 dries the recording medium P for a time corresponding to the amount of droplets to be discharged. In Modification D of the embodiment, the amount of droplets can be replaced with the size of a droplet.

In a printing mode with a small number of passes, the resolution is coarse, and the dot diameter of an ink is large. In order to form a dot with a large diameter, a larger amount of ink is used, and therefore higher drying capacity (drying power) is required. Therefore, by changing a timing of turning on an infrared ray depending on the type of the recording medium P, a printing mode (dot diameter), or the like, appropriate drying quality can be obtained.

Effects

According to the image forming method of the above embodiment or modification thereof, the sub-scanning unit 205 (an example of a conveyor) of the liquid discharge apparatus 1 intermittently conveys the recording medium P for each bandwidth BW (an example of a predetermined distance) (an example of an intermittent conveyance step). The discharge controller 204 (an example of a discharger) of the liquid discharge apparatus 1 discharges an ink (an example of a liquid) onto the recording medium P intermittently conveyed by the sub-scanning unit 205 (an example of a discharge step). The heater controller 202 (an example of a circuitry) of an image forming apparatus performs control such that the recording medium P onto which an ink has been discharged by the discharge controller 204 is irradiated with an infrared ray in a predetermined irradiation amount such that the first irradiation amount during stop of conveyance is larger than the second irradiation amount during conveyance of the recording medium (an example of irradiation step). Note that the infrared ray can be replaced with any electromagnetic wave that can dry an ink. In the recording medium P intermittently conveyed, the liquid discharge apparatus 1 of the above embodiment can prevent generation of a difference in drying amount depending on a position on the recording medium P when an infrared ray is emitted to dry an ink.

In the liquid discharge apparatus 1, the irradiation area CA of the fourth heater H4 is set to an integral multiple of a maximum bandwidth BW. Even when a printing mode is changed, in the recording medium P intermittently conveyed, the liquid discharge apparatus 1 of the above embodiment can prevent generation of a difference in drying amount depending on a position on the recording medium P when an infrared ray is emitted to dry an ink.

The heater controller 202 of the liquid discharge apparatus 1 controls the wavelength of an infrared ray emitted by the fourth heater H4. As a result, the liquid discharge apparatus 1 can emit an infrared ray having an optimum wavelength according to the composition of an ink.

The heater controller 202 of the liquid discharge apparatus 1 performs control such that a plurality of infrared heaters (an example of irradiators) emits electromagnetic waves having different wavelengths. As a result, the liquid discharge apparatus 1 can dry an ink with infrared rays having wavelengths corresponding to a plurality of ink components such as water and an organic solvent.

The communication controller 201 (an example of a receiver) of the liquid discharge apparatus 1 receives an input of drying strength (an example of an irradiation condition). The heater controller 202 of the liquid discharge apparatus 1 controls irradiation time of an electromagnetic wave by the fourth heater H4 and the wavelength of an electromagnetic wave to be emitted according to the drying strength received by the communication controller 201. As a result, the liquid discharge apparatus 1 can dry the recording medium P according to the set drying strength.

The temperature detecting element 10H (an example of a detector) in the heater H of the liquid discharge apparatus 1 detects the temperature of the recording medium P passing through the irradiation area CA. The heater controller 202 of the liquid discharge apparatus 1 performs control such that the intensity of an infrared ray to be emitted is increased in response to a detection result that the temperature detected by the temperature detecting element 10H is lower than a predetermined temperature. As a result, the liquid discharge apparatus 1 can control an output of an infrared ray by FB control. For example, the predetermined temperature can be set empirically and stored in a memory by the manufacturer.

The heater controller 202 of the liquid discharge apparatus 1 controls the intensity of an infrared ray to be emitted according to the high productivity printing mode (draft mode) as described above, and further according to a printing mode having different drying amounts such as a high image quality mode (a photograph mode or the like) or the amount or sizes of droplets of a liquid to be discharged. As a result, the liquid discharge apparatus 1 can dry the recording medium P according to the required drying amount.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention. Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A liquid discharge apparatus comprising:

a conveyor to repeat conveyance of a recording medium by a predetermined distance and stop of conveyance of the recording medium;

a liquid discharge head to discharge a liquid onto the recording medium;

an irradiation device to irradiate, with an electromagnetic wave, the recording medium onto which the liquid has been discharged by the liquid discharge head, the irradiation device disposed downstream from the liquid discharge head in a direction of conveyance of the recording medium; and circuitry configured to control the irradiation device to irradiate the recording medium, the circuitry configured to set a first irradiation amount during the stop of conveyance to a larger value than a value of a second irradiation amount during the conveyance of the recording medium.

2. The liquid discharge apparatus according to claim 1, wherein, in the direction of conveyance of the recording medium, an irradiation area irradiated with the electromagnetic wave is an integral multiple of the predetermined distance.

3. The liquid discharge apparatus according to claim 2, wherein the circuitry is configured to control a wavelength of the electromagnetic wave to be emitted.

4. The liquid discharge apparatus according to claim 3, wherein the irradiation device includes a plurality of irradiators, and wherein the circuitry is configured to control the plurality of irradiators to emit electromagnetic waves having different wavelengths.

5. The liquid discharge apparatus according to claim 4, wherein the circuitry is configured to control a wavelength of the electromagnetic wave of each of the plurality of irradiators.

6. The liquid discharge apparatus according to claim 5, wherein the circuitry is configured to accept an input of an irradiation condition of the electromagnetic wave, wherein the circuitry is configured to control an irradiation time of the electromagnetic wave by each of the plurality of irradiators and the wavelength of the electromagnetic wave according to the irradiation condition accepted.

7. The liquid discharge apparatus according to claim 1, further comprising a detector to detect a temperature of the recording medium passing through an irradiation area of the electromagnetic wave, wherein the circuitry is configured to set an intensity of the electromagnetic wave to an increased value in response to a detection result that the temperature detected by the detector is lower than a predetermined temperature.

8. The liquid discharge apparatus according to claim 1, wherein the circuitry is configured to control an intensity of the electromagnetic wave according to a printing mode.

9. An image forming method comprising:

intermittently conveying a recording medium to repeat conveyance of the recording medium by a predetermined distance and stop of conveyance;

discharging a liquid onto the recording medium;

irradiating the recording medium onto which the liquid has been discharged with an electromagnetic wave in a predetermined irradiation amount; and setting a first irradiation amount during the stop of conveyance to a larger value than a value of a second irradiation amount during the conveyance of the recording medium.

* * * * *